US006805844B1

(12) United States Patent
Holt

(10) Patent No.: US 6,805,844 B1
(45) Date of Patent: Oct. 19, 2004

(54) REACTOR VESSEL, METHOD AND SYSTEM FOR TREATING, SAMPLING, AND TRANSPORTING TOXIC WASTE

(75) Inventor: Grady Lynn Holt, Bel Air, MD (US)

(73) Assignee: Tennessee Valley Authority, Knoxville, TN (US)

( * ) Notice: Subject to any disclaimer, the term of this patent is extended or adjusted under 35 U.S.C. 154(b) by 0 days.

(21) Appl. No.: 09/518,642

(22) Filed: Mar. 3, 2000

(51) Int. Cl.[7] ..... A62D 3/00; B01J 8/00; B01J 14/00; B09B 3/00

(52) U.S. Cl. ..... 422/129; 422/236; 422/224; 422/294; 588/200; 588/900

(58) Field of Search ..... 422/294, 129, 422/99, 102, 236, 237, 224, 255, 946; 222/87, 142.5, 145.5; 588/200, 203, 218, 221, 224, 236, 242, 246, 900

(56) References Cited

U.S. PATENT DOCUMENTS

| | | | | | |
|---|---|---|---|---|---|
| 518,258 | A | * | 4/1894 | Lechartier | 169/83 |
| 3,087,638 | A | * | 4/1963 | Loper | 206/221 |
| 3,221,917 | A | * | 12/1965 | Santo et al. | 220/502 |
| 3,366,716 | A | * | 1/1968 | Cohen | 264/5 |
| 3,603,484 | A | * | 9/1971 | Ogle | 222/94 |
| 3,715,189 | A | * | 2/1973 | Nighohossian et al. | 422/61 |
| 5,064,121 | A | * | 11/1991 | Bolduc | 239/309 |
| 5,545,799 | A | | 8/1996 | Ritter | 588/200 |
| 5,574,203 | A | | 11/1996 | Noel et al. | 588/203 |

FOREIGN PATENT DOCUMENTS

FR 2590519 A * 5/1987 ..... B30B/1/32

OTHER PUBLICATIONS

European Patent Application 13822A2, Dec. 19, 1979, D. R. Wright.

* cited by examiner

*Primary Examiner*—Hien Tran
*Assistant Examiner*—Jennifer Leung
(74) *Attorney, Agent, or Firm*—Sughrue Mion, PLLC

(57) ABSTRACT

An apparatus, method and system for the treatment, sampling, and transportation of chemical weapon materiel contained in a small frangible glass, e.g., container. The apparatus, method and system permit the chemical weapon materiel to be easily treated and contained by a technician in the field to produce non-military chemicals suitable for transport and final disposal. An illustrative embodiment of the apparatus includes a single-use vessel having a compression section and a treatment portion for holding a bottle of chemical weapon materiel and a volume of treatment chemical. A cover is positioned on the vessel and is used to support a compression jack. A portion of the compression jack is installed between the cover and a compression frame and is extended until the compression section of the vessel is compressed. An impact member is attached to the cover wherein upon compression of the compressible section, the impact member breaks the bottle, thus mixing the chemical weapon materiel with the treatment chemical to produce a chemical waste that can be sampled if necessary and transported while still within the sealed vessel for final disposal.

9 Claims, 5 Drawing Sheets

REACTOR VESSEL, METHOD AND SYSTEM FOR TREATING, SAMPLING, AND TRANSPORTING TOXIC WASTE

BACKGROUND OF THE INVENTION

1. Field of the Invention

The present invention relates generally to a reactor vessel and, more particularly, to a single-use vessel and method and system for treatment and transport of toxic chemicals designed to be used as weapons. Of course, the reactor vessel and method have general application for treating chemicals and are, therefore, not limited to toxic chemicals in the weapons environment.

2. Description of the Related Art

In recent years there has been a global emphasis on a safe and economical reduction of chemical warfare-related materiels which were at one time produced in large quantities and in various configurations, such as rockets, artillery projectiles, bombs, and land mines. Many weapons and chemical warfare-related materiels were not consumed, but were buried in test ranges or at training sites. Treatment of recovered chemical warfare-related materiels found at these locations require safe handling and proper disposal.

Many known systems have been developed to aid in the treatment and disposal of chemical weapons. For example, U.S. Pat. No. 5,545,799, issued Aug. 13, 1996, teaches chemical destruction of toxic organic compounds, such as mustard gas, by reaction with hydrogen peroxide ($H_2O_2$). The main reactor is connected to a blanketing inert gas supply line, a catalyst vessel, three chemical supply lines, cold and hot heat exchangers, an interim storage tank, and a liquid knockout vessel with a liquid discharge and a vent to a carbon bed, a flare, or an incinerator. The optional equipment includes an inline mixer for the supplied chemicals, a spray nozzle in the main reactor, and probes for the monitoring of the pH and the temperature. However, this system is not practical for use in the field with a small number of chemical weapons.

In U.S. Pat. No. 5,574,203, issued Nov. 12, 1996, there is taught a process and installation for destroying munitions containing toxic agents by pyrotechnic fragmentation in a lidded pool of neutralizing liquid. The pool is constructed of a ductile, flexible, and tearproof materiel that is supported by its installation in hollowed out, compacted, and stable ground. The example of the required pool size that is given is 12 meters in diameter by 6 meters in depth, a volume in which the suspended munitions are to be centered. The application of this process to munitions containing mustard gas agent has been tried and evaluated at the Centre d'Etudes du Bouchet in France. Problems identified with the process include a low processing rate of four shells per hour, a dependence on the munitions explosive charge, accumulations of metal fragments in the pool, and difficulties in processing arsenic-containing, thickened, or viscous agents.

European Patent No. EP 13,822, teaches improvements in the treatment of hazardous waste, and is somewhat similar to U.S. Pat. No. 5,574,203, supra. It is described as follows: "In a process for pretreating hazardous waste prior to solidification, the waste is received in containers. The containers are deposited in a large vessel containing chemical pretreatment media and subjected to an agitating process in the vessel whereby the containers are ruptured and their contents deposited in the media. Neutralization, precipitation, and chemical modification processes are envisaged in the container. After pretreatment the liquid is removed for ultimate solidification." The patent describes the vessel as being an octagonal prism about ten meters across in size, with a sieve side wall for the removal and treatment of the media and a four-armed diametrical rotating agitator that not only ruptures drums of waste but reduces each one to compact balls that ultimately dissolve in the media.

Many of the known systems are time-consuming, require great care and are complicated. They typically require expensive handling, processing, monitoring, and control to ensure the safety of potentially exposed workers, as well as the general public and the environment. The chemical agents that must be treated are often contained within small glass ampoules or bottles, such as Chemical Agent Identification Sets (CAIS). However, most of the previous technologies are applicable primarily to chemical agents in munitions and large containers and are too complicated and expensive to be of practical use with one or two glass containers.

SUMMARY OF THE INVENTION

It is an object of the present invention to provide an apparatus, method and system for the safe treatment, sampling, and transportation of chemical weapon materiels contained in small frangible, typically glass, containers. Hereafter for brevity the discussion herein is in terms of glass containers, bottles or ampoules. The invention is not so limited. Accordingly, the present invention provides a sealed reactor vessel within which a glass bottle or ampoule containing an unsafe, usually extremely toxic chemical can be safely accessed. A liquid reaction occurs between the chemical released from the bottle and a second chemical placed inside the vessel. The chemicals combine to produce a product, usually a chemical waste product, that can then be sampled, if necessary, and transported while still within the sealed reactor vessel for disposal.

Although the apparatus, method and system are disclosed in the context of chemical weapons, it is a further object of the present invention to provide an apparatus and method for disposing of undesired, typically toxic, chemicals in general.

More specifically, an embodiment of the present invention relates to an apparatus having a single-use vessel for holding a bottle of chemical warfare-related materiel and a treatment chemical. The vessel further includes a compression section, a treatment portion and a cover. A compression support frame is fixedly mounted with respect to the vessel and extends over the cover. A jack is positioned on the cover and is operative to expand into the compression support frame so that a force is transferred to the compressible section causing it to compress. An impact member is fixed to the cover so that when the cover is lowered due to deformation of the compressible section, the impact member breaks the bottle, thus mixing the contents of the chemical weapon materiel with the treatment chemical to render the chemical weapon materiel less harmful.

The present invention still further provides a reactor for treating and disposing of chemicals, typically toxic chemicals such as chemical warfare materiels, comprising a treatment vessel for holding a volume of a treatment too chemical and a bottle of a toxic chemical which in its most preferred form is portable by hand and can even be hand held. The vessel has a top, a base and at least one impact weight, such as a steel ball bearing, movably positioned therein. Upon agitation or movement of the treatment vessel, the impact weight contacts and opens the bottle, thus releasing the toxic chemical, which is then mixed with the treatment chemical. The invention also contemplates a penetration pin fixed to the base within the treatment vessel to facilitate the opening of the bottle.

The present invention still further provides a first method for treating a chemical, typically a toxic chemical, using a single use vessel having a compressible section, the method comprising the steps of placing a bottle in the vessel so that the bottle is internally aligned with an impact member, inserting a treatment chemical into the vessel and sealing the vessel. The method further includes operating a jack so that a force is exerted upon the compressible section, which causes the compressible section to be compressed, and the impact member to break the bottle so that the treatment chemical is mixed with the (toxic) chemical and rendered less harmful.

The present invention also provides a method for treating a toxic chemical using a hand held treatment vessel, the method comprising the steps of: placing a bottle of a toxic chemical in the hand held treatment vessel; inserting a treatment chemical into the hand held treatment vessel; placing a weight into the hand held treatment vessel; sealing the hand held treatment vessel; striking an end of the hand held treatment vessel so that the weight breaks the bottle; and shaking the hand held treatment vessel to facilitate mixing between the treatment chemical and the toxic chemical.

In the system of the present invention, the toxic chemical and treatment chemical are present and reaction thereof is shortly to be initiated.

Features of the present invention include suitable vessel size for a single glass container and mobility. While in theory a plurality of small glass containers could be processed in accordance with the present invention, for reasons which should be self-apparent, the present invention finds particular use with a vessel size appropriate for a single glass container. With respect to mobility, since it is contemplated in accordance with the present invention that the reactor vessel be transportable by hand, most preferably by a single individual, for ease of mobility and use, a weight of approximately 50 lbs. with a volume of approximately 2 liters appears to be most suitable and convenient. The invention further allows for safe container opening without an agitator, suitability for use as a shipping container after initial treatment and ultimate disposal without solidification, thus providing a simple and effective means for disposal of (toxic) chemicals. These features translate into improved safety for operators and surrounding communities while providing for substantial reductions in the cost and time to dispose of, e.g., harmful chemical weapons.

BRIEF DESCRIPTION OF THE DRAWINGS

The present invention will be better understood from a consideration of the following description taken in connection with the accompanying drawings of two embodiments of the reactor vessel, in which.

DETAILED DESCRIPTION OF THE PREFERRED EMBODIMENTS

In general, a reactor according to the invention safely disposes of a single container of a toxic chemical, such as a glass ampoule containing chemical weapons. The invention is configured to provide a vessel for breaking the container so that an enclosed chemical weapon materiel is released and immediately mixed with a treatment chemical.

Figure 1:
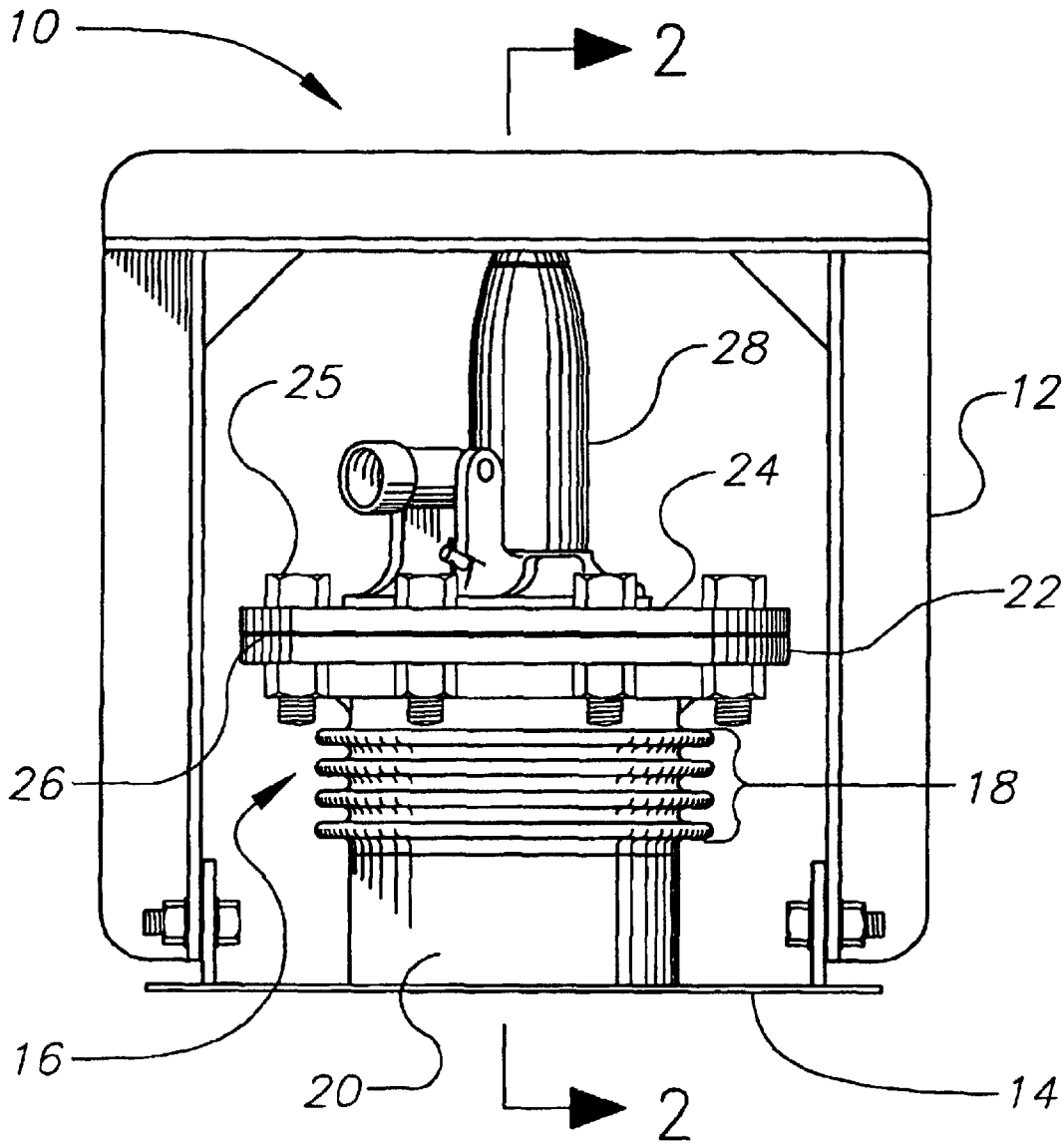
FIG. 1 is a side view of the first embodiment of the reactor vessel.
Figure 2:
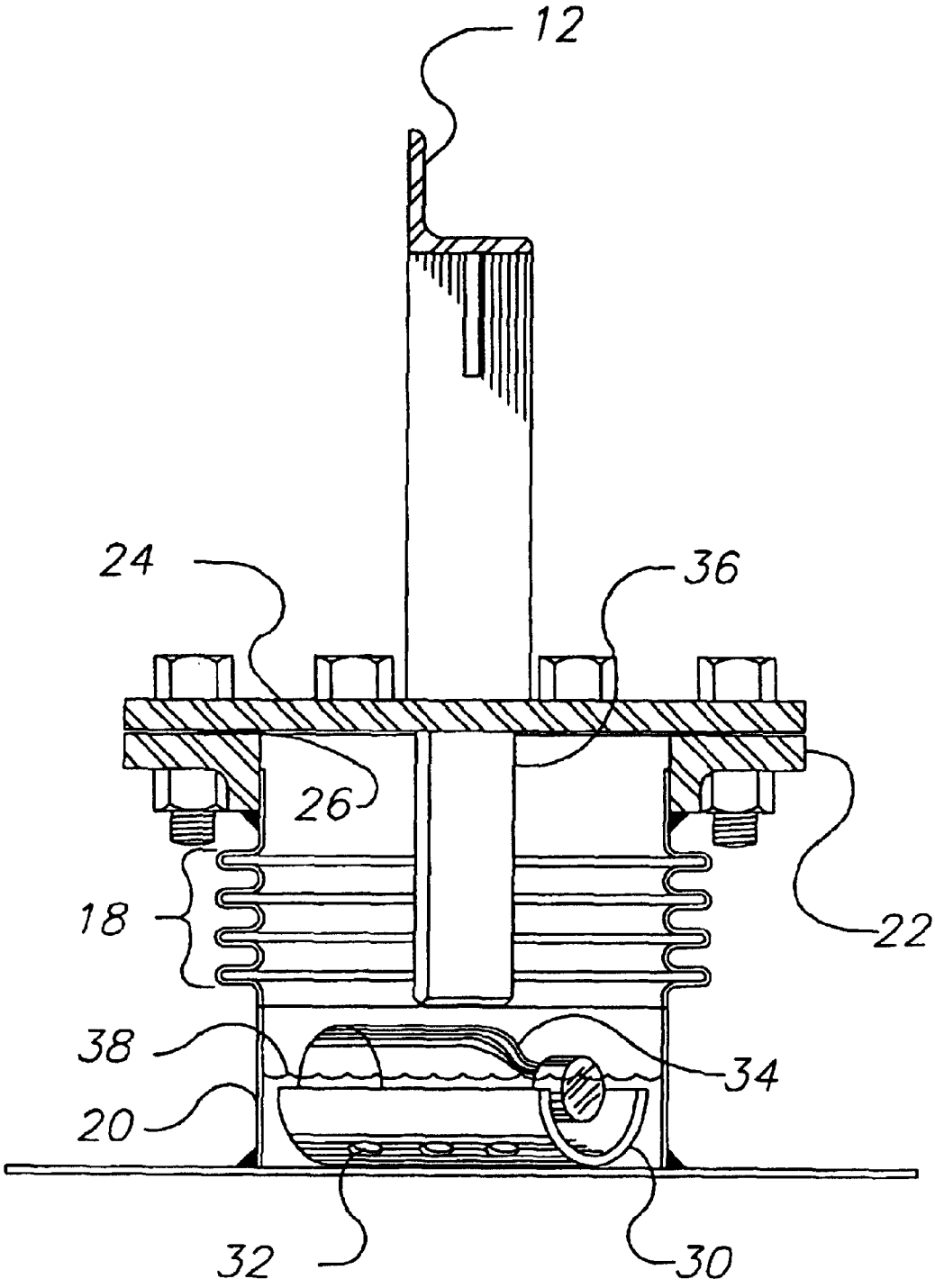
FIG. 2 is a sectional view along the lines 2—2 in FIG. 1 of a first embodiment of the reactor vessel.

An illustrative embodiment of a single-use compressible reactor 10 for treatment and transport of toxic chemicals according to the invention is generally shown in FIG. 1. The reactor 10 includes a compression support frame 12 coupled to a base 14. A vessel 16 is fixed to the base 14 and includes a compressible section 18 and a treatment portion 20. A flange 22 is fixed to a top portion of the vessel 16 and provides a support surface for a cover 24. The cover 24 is attached to the flange 22 by a fastening means, such as a plurality of bolts 25. A cover gasket 26 is positioned between the flange 22 and the cover 24 to provide a sealing effect between the two. A hydraulic compression jack 28 is positioned on the cover 24 and is operative to expand and contact the compression support frame 12. With additional reference to FIG. 2, a cradle 30 having penetrations or apertures 32 is positioned on a bottom area of the treatment portion 20 for securing a frangible bottle 34, such as a glass ampoule. An impact member 36, such as a blade is attached to the cover 24 and extends downwardly through the inside of the vessel 16 towards the bottle 34.

In operation, the cover 24 is removed and the bottle 34, containing a highly toxic substance or chemical, is carefully placed in the cradle 30 of the treatment portion 20. A treatment chemical 38 is added and the cover 24 is secured to the flange 22. It is important that the vessel 16 is properly sealed due to the toxicity of the chemical to be treated. The hydraulic compression jack 28 is operative to expand and forcefully engage with the compression support frame 12. Continued operation of the hydraulic compression jack 28 causes a compression force to be transferred to the compressible section 18 of the vessel 16, thus reducing the height of the vessel 16 and forcing the impact member 36 into the bottle 34, which causes the toxic chemical to be released. The vessel 16 is then shaken to mix the toxic chemical and the treatment chemical 38 while penetrations 32 in the cradle 30 facilitate mixing of the chemicals. The resulting waste product, which is typically less harmful, is then transported to a final treatment or disposal facility.

Figure 3:
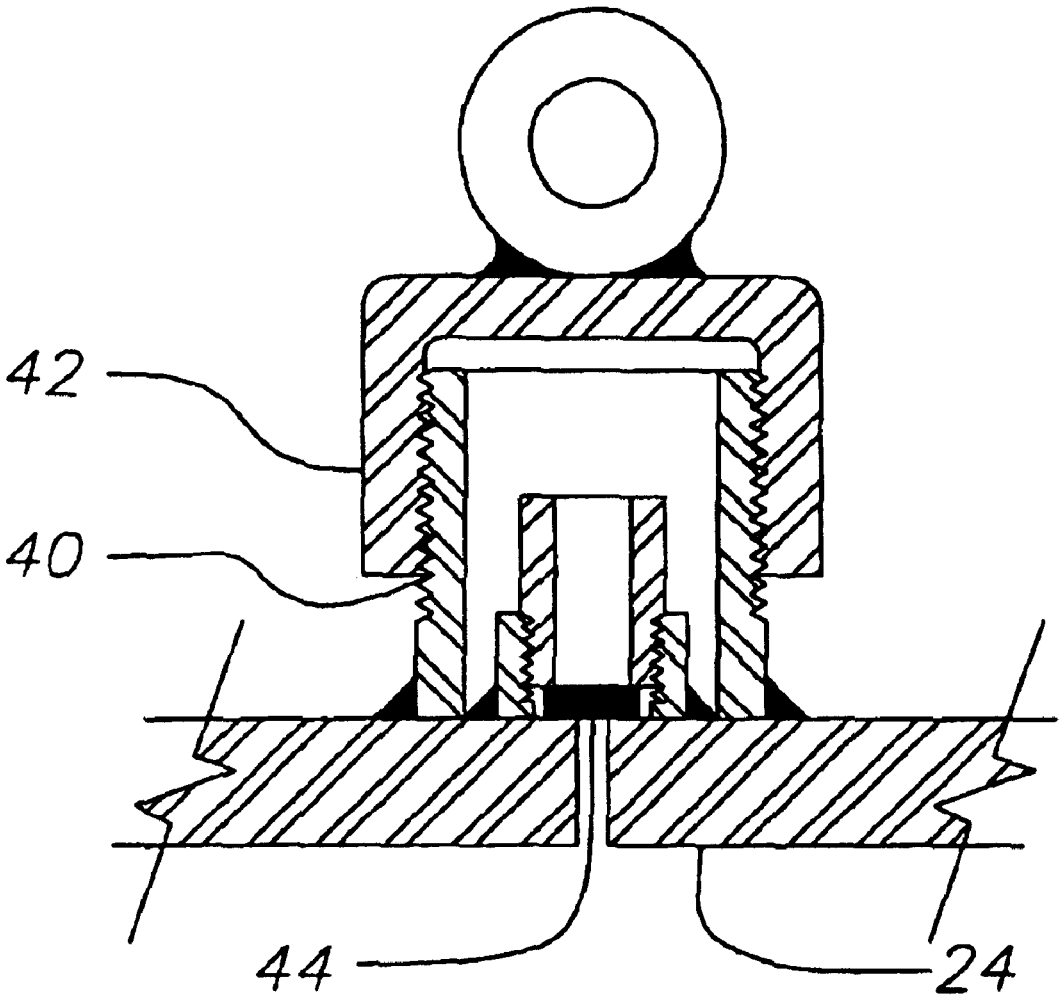
FIG. 3 is a sectional view along the lines 3—3 in FIG. 4 of the septum sample access port for both embodiments.
Figure 4:
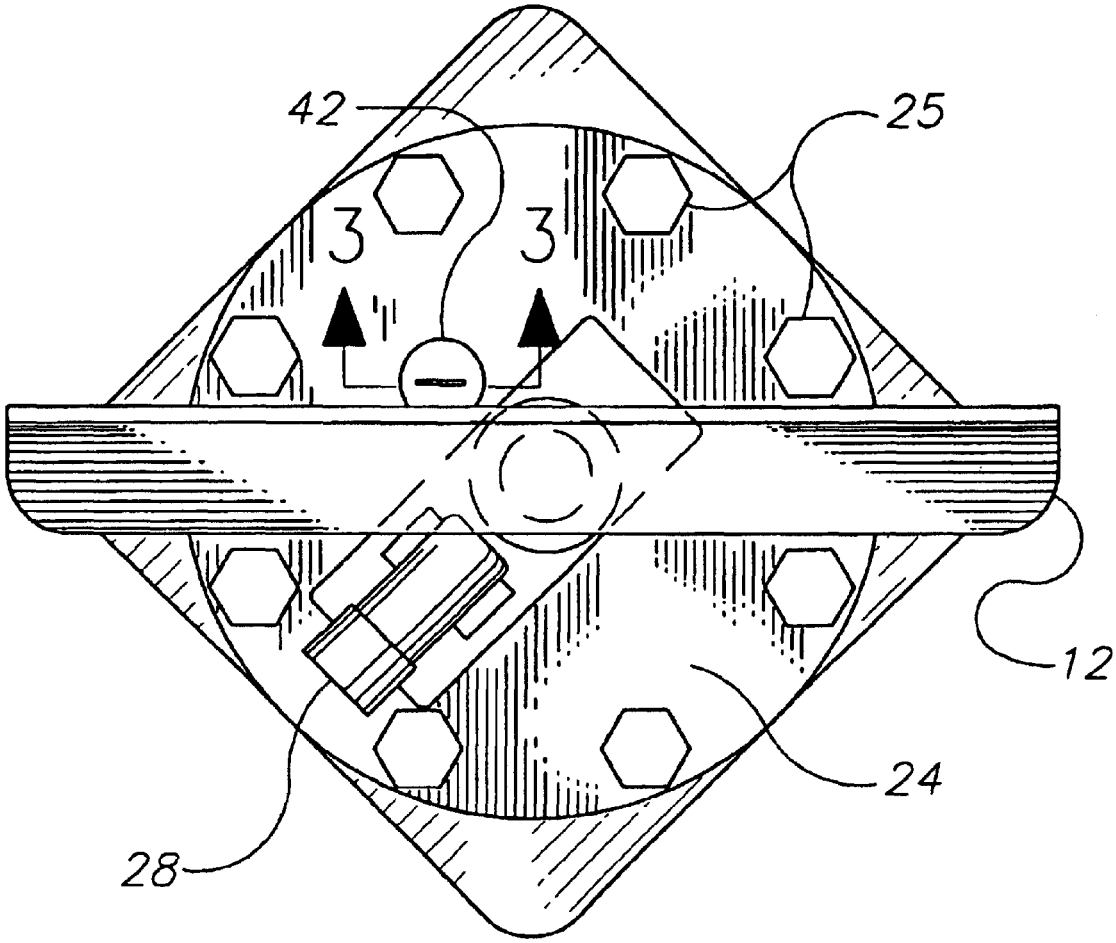
FIG. 4 is a top view of FIG. 1 of the first embodiment of the reactor vessel.

Examples of the types of toxic chemical agents which may be treated preferably but not necessarily include: sulfur mustards, nitrogen mustards, and Lewisite. Some of the chemical compounds are in chloroform solution, packed in sealed Pyrex ampoules. Others are in undiluted (neat) form or adsorbed on charcoal granules and packed in small glass bottles The treatment of the toxic chemical agents is based on chemical neutralization processes designed to convert chemical agents into chemical wastes that can be released from Army control and which are similar to the industrial chemicals that can be transported to a hazard waste treatment, storage and, disposal facility for final disposition. An example of a primary component of a treatment reagent is 1,3-dichloro-5,5-dimethylhydantoin because of its potential for breaking the molecular bonds of the toxic chemical agents With reference to FIGS. 3 and 4, the invention further includes a means of access to the vessel 16 for testing the reactants for chemical reaction completion. After treatment, an access cover 42 is removed from an access port 40 and through the use of a syringe, a sample of the reactants is collected through a septum 44, which is formed within the cover 24. The access cover 42 is then replaced and the reactor and its waste contents are then transported to a facility for treatment, storage and final destruction.

Figure 5:
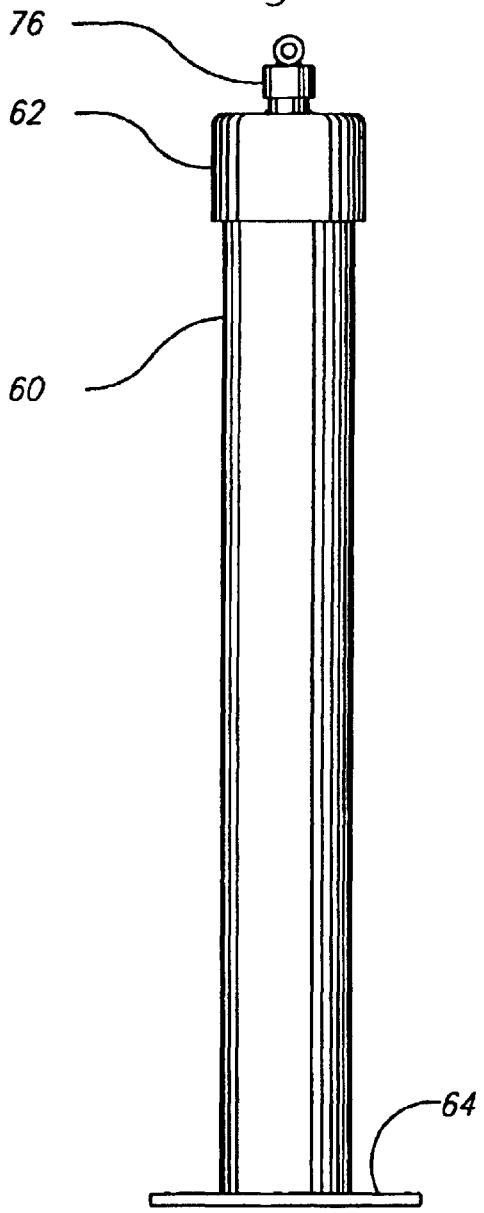
FIG. 5 is a side view of a second embodiment of the reactor vessel.
Figure 6:
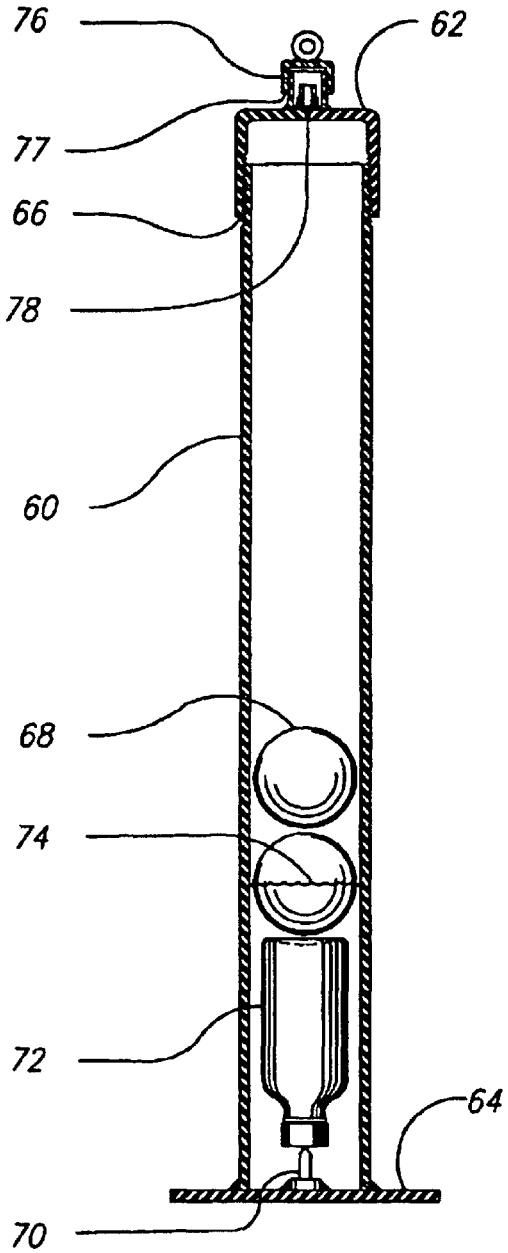
FIG. 6 is a sectional view along the lines 6—6 in FIG. 7 of a second embodiment of the reactor vessel.

A particular embodiment of a reactor in accordance with the present invention is illustrated in FIGS. 5–6. A hand held treatment vessel 60 is provided having a cover 62 and a base portion 64. A gasket 66 is provided between the treatment vessel 60 and the cover 62 to aid in sealing. At least one weight 68 is slidably positioned within the treatment vessel 60. In further accordance with the invention, a penetration pin 70 is fixed to the base portion 64, inside of the treatment vessel 60.

In operation of the aforementioned embodiment, the top 62 is removed and a frangible, typically glass, ampoule or bottle 72 containing a highly toxic substance or chemical is carefully placed inside the treatment vessel 60. The weight 68 and a treatment chemical 74 are added to the treatment vessel 60 and the cover 62 is securely fastened to create a seal. Due to the toxicity of the chemical involved, it is important that the treatment vessel 60 is properly sealed. The treatment vessel 60 is then picked up and, while held in a substantially vertical position, the base portion 64 is struck on the ground causing the weight 68 to collide with and break the bottle 72, thus allowing the treatment chemical 74 to mix with the toxic chemical released from the bottle 72. The treatment vessel 60 is then repeatedly inverted to facilitate mixing of the chemicals.

Figure 7:
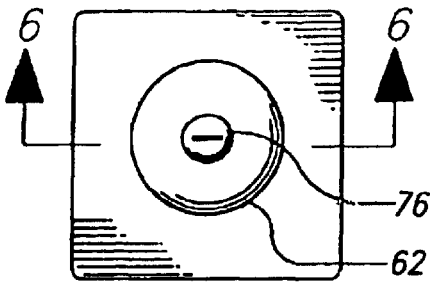
FIG. 7 is a top view of a second embodiment of the reactor vessel.

With additional reference to FIG. 7, the treatment vessel 60 further includes a septum cover 76 coupled to the cover 62 of the treatment vessel 60. A gasket 77 is positioned between the covers 76 and 62 to facilitate sealing between the two. Removal of the septum cover 76 permits access to a septum 78. Using a syringe, a sample of the contents of the treatment vessel 60 is collected for analysis. After replacing the septum cover 76, the treatment vessel 60 and its waste contents are transported for final disposal.

Although the invention is described as holding one bottle of a toxic chemical, it will be appreciated that a reactor according to the invention can be implemented to hold more than one bottle.

Although the invention is shown and described as using a hydraulic jack, it will be appreciated that any of various other expandable mechanisms can be used, such as a mechanical screw jack or an electric motor driven jack or the like.

Although the invention is shown and described as using a blade as an impact member, it will be appreciated that any of various other resilient objects may be used, such as a punch or a rectangular piece of metal or the like.

With respect to the compressible section 18, any flexible container having sufficient strength that exceeds that of a frangible container such as a glass bottle placed inside which also resists corrosion or deterioration by the chemical being treated, treatment chemical, or resulting chemical wastes could be a suitable reaction vessel for this treatment system, such as flexible tubing or the like.

It is contemplated that numerous modifications may be made to the apparatus of the present invention without departing from the spirit and scope of the invention as defined in the following claims.

What is claimed is:

1. A compressible reactor for treating and disposing of a toxic chemical, said compressible reactor comprising:

a frangible container containing the toxic chemical;

a single use vessel for holding the frangible container in a fixed position and for holding a volume for treatment chemical, said single use vessel having an upper compressible section and a lower treatment portion containing the fixed frangible container;

a cover fastened to said single use vessel;

a septum formed within said cover;

a compression support frame fixedly mounted with respect to said single use vessel;

a means for fixing the frangible container in the lower treatment portion, said means comprising a cradle positioned within said treatment portion;

a jack positioned on said cover, said jack being operative to extend between said cover and said compression support frame so that said compressible section of said vessel is compressed; and an impact member fixed to said cover, wherein upon compression of said upper compressible section, said impact member approaches and breaks said fixed frangible container to release the toxic chemical into the lower treatment portion.

2. The compressible reactor of claim 1, wherein said frangible container is a glass ampoule.

3. The compressible reactor of claim 1, wherein said frangible container contains a chemical weapon material.

4. The compressible reactor of claim 1, wherein said cradle contains penetrations to facilitate mixing of said toxic chemical and said treatment chemical.

5. The compressible reactor of claim 1, wherein said cover includes a cover gasket.

6. A method for treating a toxic chemical using a single use vessel having an upper compressible section and a lower treatment portion, said method comprising the steps of:

placing a frangible container containing the toxic chemical in the lower treatment portion of said single use vessel so that said frangible container is fixed in said lower treatment portion and internally aligned with an impact member located on a cover of the single use vessel;

inserting a treatment chemical into said single use vessel;

sealing said single use vessel with said cover;

positioning a jack on said cover and operating said jack so that a force is exerted upon said compressible section such that said compressible section is compressed and, by means of the compression, said impact member approaches and breaks said frangible container so that said treatment chemical is mixed with said toxic chemical;

shaking said single use vessel to facilitate mixing between said treatment chemical and said toxic chemical; and sampling said treatment chemical mixed with said toxic chemical through a septum formed within said cover.

7. A system for treating and disposing of a toxic chemicals said system comprising:

a frangible container containing the toxic chemical;

a single use vessel holding the frangible container in a fixed position and also holding a volume of treatment chemical, said single use vessel having an upper compressible section and a lower treatment portion containing the fixed frangible container;

a cover fastened to said single use vessel;

a septum formed within said cover;

a compression support frame fixedly mounted with respect to said single use vessel;

a means for fixing the frangible container in the lower treatment portion, said means comprising a cradle positioned within said treatment portion;

a jack positioned on said cover, said jack being operative to extend between said cover and said compression support frame so that said compressible section of said vessel is compressed; and an impact member fixed to said cover, wherein upon compression of said compressible section, said impact member breaks said frangible container and releases said toxic chemical to react with said treatment chemical.

8. A compressible reactor for treatment and disposing of a toxic chemical, said compressible reactor comprising:

a frangible container containing the toxic chemical;

a single use vessel for holding the frangible container and a volume of treatment chemical, said single use vessel having an upper compressible section and a lower treatment portion a cover fastened to said single use vessel;

a septum formed within said cover;

a compression support frame fixedly mounted with respect to said single use vessel;

a means for fixing the frangible container in the lower treatment portion is said means comprising a cradle positioned within said treatment portion;

a jack positioned on said cover, said jack being operative to extend between said cover and said compression support frame so that said compressible section of said vessel is compressed; and an impact member fixed to said cover, wherein upon compression of said upper compressible section, said impact member approaches and breaks said frangible container to release the toxic chemical.

9. A method for treating a toxic chemical using a single use vessel having an upper compressible section and a lower treatment portion, said method comprising the steps of:

placing a frangible container containing a toxic chemical in said single use vessel so that said frangible container is fixed in said lower treatment portion and internally aligned with an impact member located on a cover of the single use vessel;

inserting a treatment chemical into said single use vessel;

sealing said single use vessel with said cover;

positioning a jack on said cover and operating the jack so that a force is exerted upon said compressible section such that said compressible section is compressed and said impact member, by means of the compression, approaches and breaks said frangible container so that said treatment chemical is mixed with said toxic chemical;

shaking said single use vessel to facilitate mixing between said treatment chemical and said toxic chemical; and sampling said treatment chemical mixed with said toxic chemical through a septum;

wherein said method is practiced using the compressible reactor of claim 1.

* * * * *